United States Patent [19]

Fletcher

[11] Patent Number: 4,841,752

[45] Date of Patent: Jun. 27, 1989

[54] ROBBER DETERRENT APPARATUS

[76] Inventor: Richard N. Fletcher, Rt. 1, Box 343A, Lake Toxaway, N.C. 28747

[21] Appl. No.: 113,056

[22] Filed: Oct. 27, 1987

[51] Int. Cl.[4] ..... E05G 3/00

[52] U.S. Cl. ..... 109/20; 109/29

[58] Field of Search ..... 109/20, 29, 32, 30, 109/31, 10, 21, 2

[56] References Cited

U.S. PATENT DOCUMENTS

| | | | |
|---|---|---|---|
| 1,191,400 | 7/1916 | Cilley | 109/20 |
| 1,358,638 | 11/1920 | Hill | 109/20 |
| 1,593,536 | 7/1926 | McClees | 109/20 |
| 1,603,452 | 10/1926 | Collins | 109/20 |
| 1,645,131 | 10/1927 | Gerey | 109/20 |
| 1,912,055 | 5/1933 | Young | 109/20 |
| 2,011,120 | 8/1935 | Searle | 109/20 |
| 2,072,941 | 3/1937 | Burch | 109/20 |
| 3,230,912 | 1/1966 | Hohmann | 109/20 |
| 3,965,827 | 6/1976 | Reeves | 109/20 |
| 4,002,303 | 12/1977 | Fegley | 109/29 |

FOREIGN PATENT DOCUMENTS

| | | | |
|---|---|---|---|
| 251373 | 5/1963 | Australia | 109/32 |

*Primary Examiner*—Robert L. Wolfe

*Attorney, Agent, or Firm*—Leon Gilden

[57] ABSTRACT

A theft deterrent apparatus is set forth wherein a plurality of nozzles are positioned within an elongate deflecting shield such that they may be manually and selectively activated by a foot pedal or secondary switch positioned for manual manipulation such as on a cash register. The nozzles dispense a disabling fluid chemical upon activation of a control valve by the foot pedal and cash register positioned switch. Optionally an overhead bank of similar fluid dispensing nozzles may be oriented where counter level positioning of such nozzles is not desirable. Alternatively, the counter mounted and overhead mounted nozzles may be utilized in combination.

3 Claims, 4 Drawing Sheets

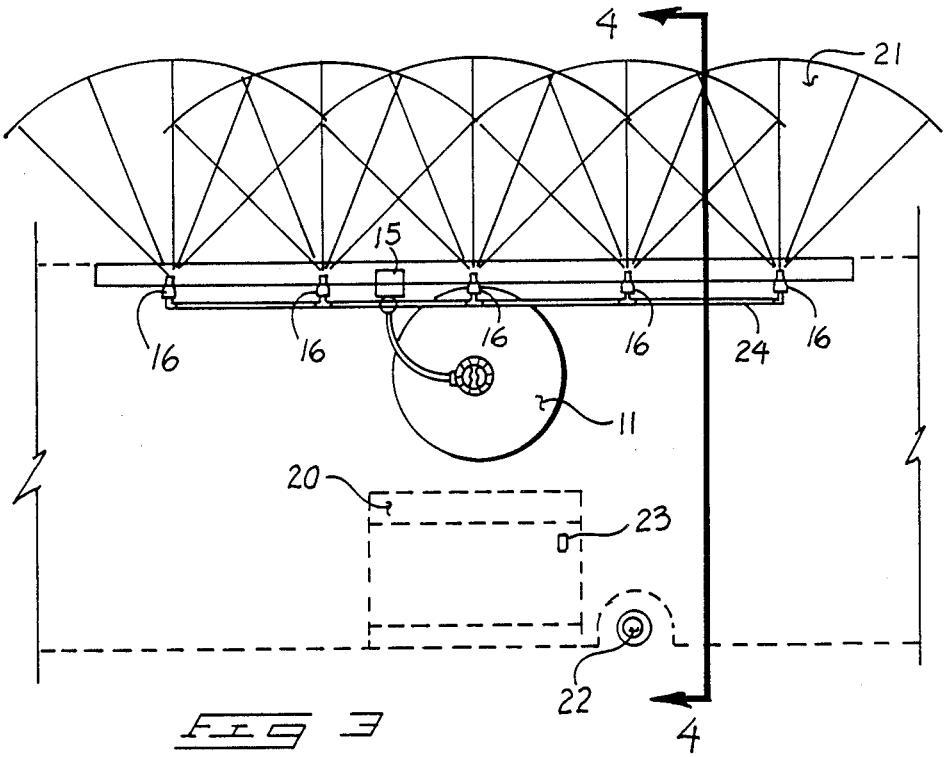
FIG 3
FIG 4
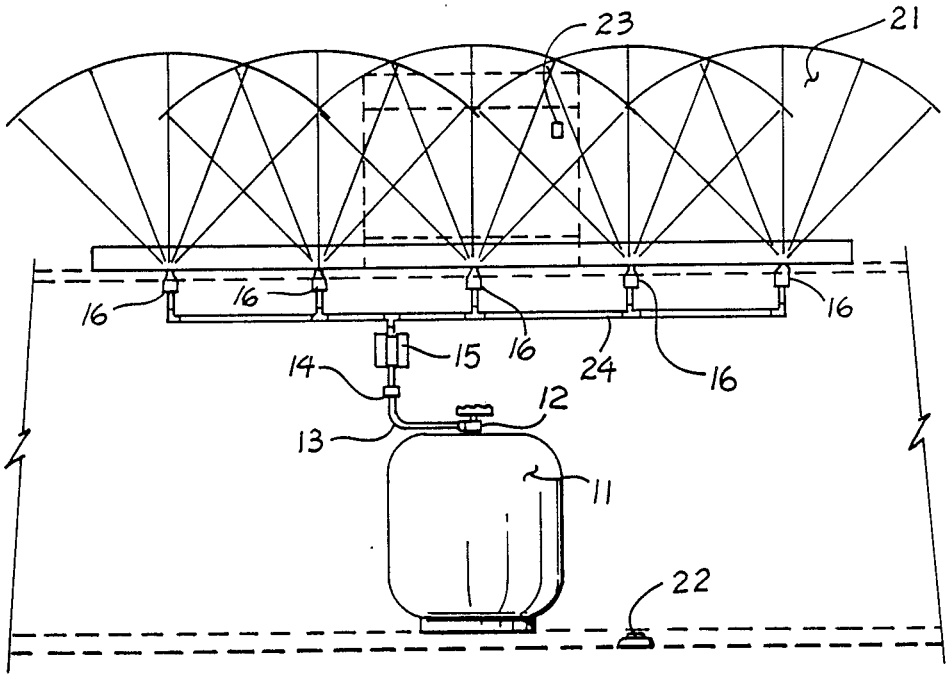

ROBBER DETERRENT APPARATUS

BACKGROUND OF THE INVENTION

1. Field of the Invention

The present invention relates to robber deterrent apparatus, and more particularly pertains to a new and improved robber deterrent apparatus which dispenses, on command, a directed pattern of spray to impinge on a would be robber as a deterrent.

2. Description of the Prior Art

The use of spray apparatus and especially the use of spray apparatus in conjunction with the application of disabling chemical fluid upon a would be robber has been utilized by the prior art. As may be appreciated, these devices have normally been of limited effectiveness due to their arrangement or orientation or even the means by which the various liquid deterrent chemicals and nozzles associated therewith were activated in use. Understandably, devices of this type have normally required expansive space for their positioning and application. For example, U.S. Pat. No. 1, 191, 400 to Cilley illustrates a counter mounted switch to activate a series of nozzles associated with a compressed air motive source connected thereto to create a deterrent effect and discharge a saline fluid from a bank of chemical reservoirs. The Cilley patent provides for limited activation of the associated nozzles and furthermore requires a cumbersome bank of reservoir container in application of spray. The absence of a shielding device in the Cilley patent further places a store employee at risk of chemical application.

U.S. Pat. No. 1,358,638 to Hill illustrates the use of a mounted series of nozzles to discharge air and thereby dispel a quantity of treated powder for purposes disabling a robber. The nozzles are positioned in an underlying manner to an associated counter and are of limited applicability in impinging upon a robber not appropriately positioned for the nozzles. Furthermore, the mechanism must be manually activated by a rotatable gas nozzle valve.

U.S. Pat. No. 1,912,055 to Young illustrates the use of a protective device wherein a plurality of nozzles discharge a temporarily disabling gas and a combustible mixture, the latter of which to be ignited in an overlying manner to a would be robber. The mechanism of Young endangers not only the robber but the employee as well wherein the utilization of combustible mixtures, as well as limited nozzle presentation, renders the Young apparatus unfit for contemporary usage.

U.S. Pat. No. 3,230,912 to Hohmann provides for a series of perimeter nozzles about a glass bank teller's window wherein upon activation of a relay and timing device a discharge of dye solution and chemical agent is imposed on a would be robber. The orientation and configuration of the Hohmann device, as well as its limited means for activation, renders the apparatus somewhat limited in use whereas positioning of a robber not directly in front of the perimeter nozzles would limit the effectiveness dramatically of the apparatus.

U.S. Pat. No. 3,965,827 to Reeves illustrates the use of an overlying trap for a would be criminal, whereupon activation of a foot switch, drops a transparent cage over the would be criminal to totally entrap and enclose him therein including a gas canister to render the criminal helpless within the cage. The awkwardness and somewhat severe nature of the apparatus would tend to limit its application in contemporary usage.

U.S. Pat. No. 4,062,303 to Fegley utilizes a nozzle to be activated and accordingly discharge a disabling chemical such as tear gas onto a would be burglar upon the actuation thereof by the opening of a door or window relative to the gas canister enclosing the aforenoted chemical. The canister device of Fegley is rather limited in scope and application relative to the instant invention.

As such it may be appreciated that there is a continuing need for a new and improved robber deterrent apparatus which addresses both the problem of effectiveness, storage, and activation, and in this respective the present invention substantially fulfills this need.

SUMMARY OF THE INVENTION

In view of the foregoing disadvantages inherent in the known types of robber deterrent apparatus now present in the prior art, the present invention provides a robber deterrent apparatus presenting an array of directed nozzles that simultaneously shields an employee while broadcasting a disabling spray onto a would be robber. As such, the general purpose of the present invention, which will be described subsequently in greater detail, is to provide a new and improved robber deterrent apparatus which has all the advantages of the prior art deterrent apparatus and none of the disadvantages.

To attain this, the present invention comprises a deterrent apparatus which may be compactly and conveniently positioned within a counter and activated by means of a plurality of remotely actuable switch means. Valves are activated releasing a disabling chemical spray via an array of nozzles onto a robber or the like. Shielding is provided to protect the nozzles and simultaneously insure the spray does not impinge upon an employee or the like when activating the nozzles. Nozzles may be positioned within a counter, as noted, or oriented in an overlying orientation to the counter, such as in a ceiling support orientation.

My invention resides not in any one of these features per se, but rather in the particular combination of all of them herein disclosed and claimed and it is distinguished from the prior art in this particular combination of all of its structures for the functions specified.

There has thus been outline, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is of enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved robber deterrent apparatus which has all the advantages of the prior art robber deterrent apparatus and none of the disadvantages.

It is another object of the present invention to provide a new and improved robber deterrent apparatus which may be easily and efficiently manufactured and marketed.

It is a further object of the present invention to provide a new and improved robber deterrent apparatus which is of a durable and reliable construction.

An even further object of the present invention is to provide a new and improved robber deterrent apparatus which is susceptible of a low-cost of manufacture with regard to both materials and labor, and which accordingly is then susceptible of low prices of sale to the consuming public, thereby making such robber deterrent apparatus economically available to the buying public.

Still yet another object of the present invention is to provide a new and improved robber deterrent apparatus which provides in the apparatuses and methods of the prior art some of the advantages thereof, while simultaneously overcoming some of the disadvantages normally associated therewith.

Still another object of the present invention is to provide a new and improved robber deterrent apparatus presenting a series of remotely actuable nozzles for disbursing a pattern of liquid chemical immobilizing spray.

Yet another object of the present invention is to provide a new and improved robber deterrent apparatus wherein nozzles associated with the apparatus are positionable within a counter arrangement, in a ceiling supported overlying orientation, or both.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 3 is an orthographic top view of the present invention illustrating the orientation of the nozzles and the spray pattern therefrom.

FIG. 4 is an orthographic side view taken in elevation along the lines 4—4 in FIG. 3 in the direction indicated by the arrows.

DESCRIPTION OF THE PREFERRED EMBODIMENT

Figure 1:
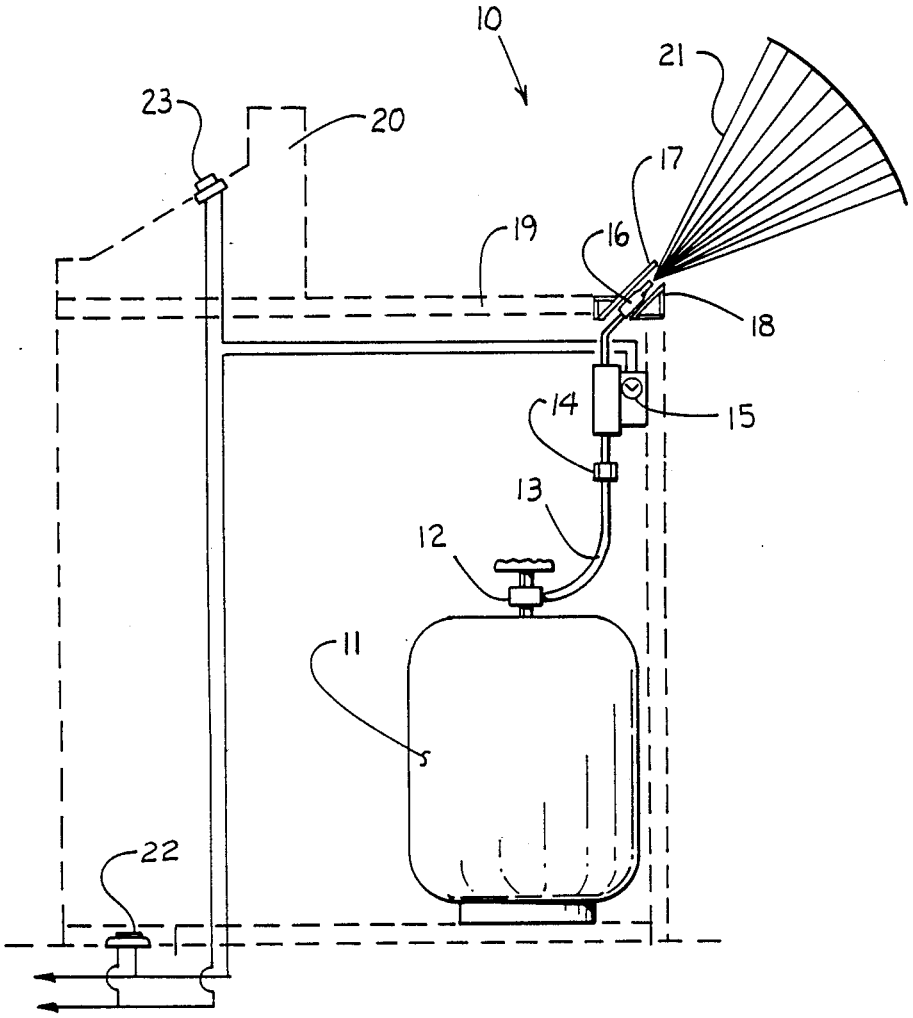
FIG. 1 is an orthographic side view of the present invention illustrating the apparatus positioned within a counter arrangement.
Figure 2:
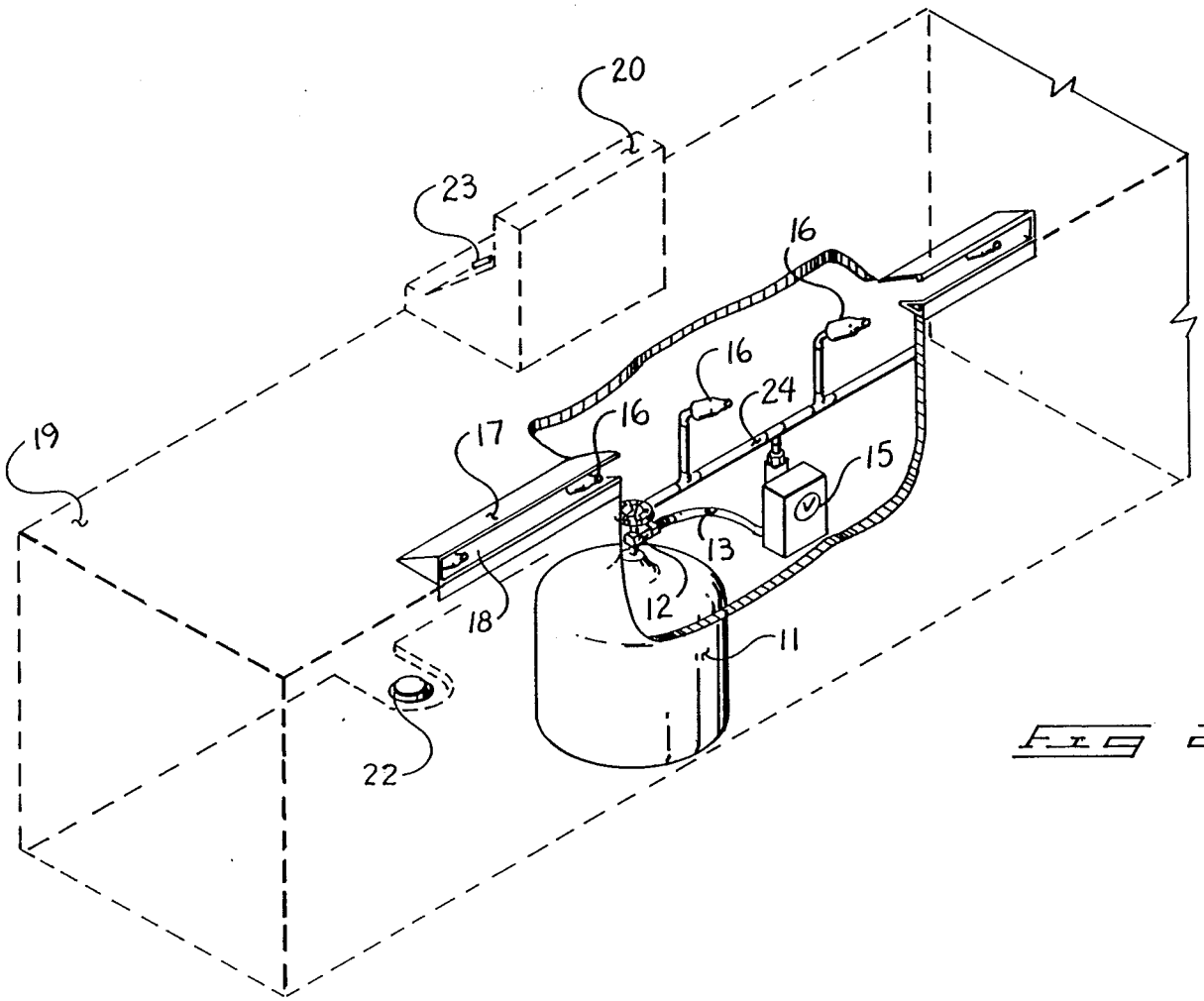
FIG. 2 is an isometric illustration of the present invention of a partially cut-away view of the nozzles positioned within a counter arrangement illustrated in phantom.

With reference now to the drawings, and in particular to FIG. 1 thereof, a new and improved robber deterrent apparatus embodying the principles and concepts of the present invention and generally designated by the reference numeral 10 will be described.

More specifically, it will be noted that the robber deterrent apparatus 10 essentially comprises a pressurized storage tank 11 within which a disabling chemical liquid is stored under pressure. Nerve disabling chemicals, such as Mace, may be utilized. A manually operable valve 12 is associated with tank 11 to enable replacement of tank 11 or transport thereof. A coupling 14 associates a flexible hose 13 emanating from valve 12 to an electrically operated solenoid valve 15. Valve 15 is energized by engagement of a floor mounted switch 22 and selectively by a cash register mounted switch 23 attached to a cash register 20 for purposes of masking the positioning of such a switch. Retrofit of a valve 23 to a register 20 merely requires association of the engagement wires and mounting of the switch on a face of register 20 where space allows.

A bank of nozzles 16, as illustrated in FIGS. 3 and 4, for example, disperse a pattern of cone-like sprays indicated as pattern 21, upon activation of valve 15. An overlying shield 17 provides a dual function of preventing tampering of nozzle 16 in cooperation with an underlying shield 18 and furthermore limits the potential of spraying of a user positioned behind counter 19, such as an employee who may actuate switch 23 and switch 22. The shield 17 in its projecting orientation relative to nozzles 16 limits a deflection by a would be robber of spray 21 to the aforenoted employee. A connecting conduit 24 associates the plurality of nozzles 16 with the flow of chemical fluid from pressurized tank 11.

Figure 5:
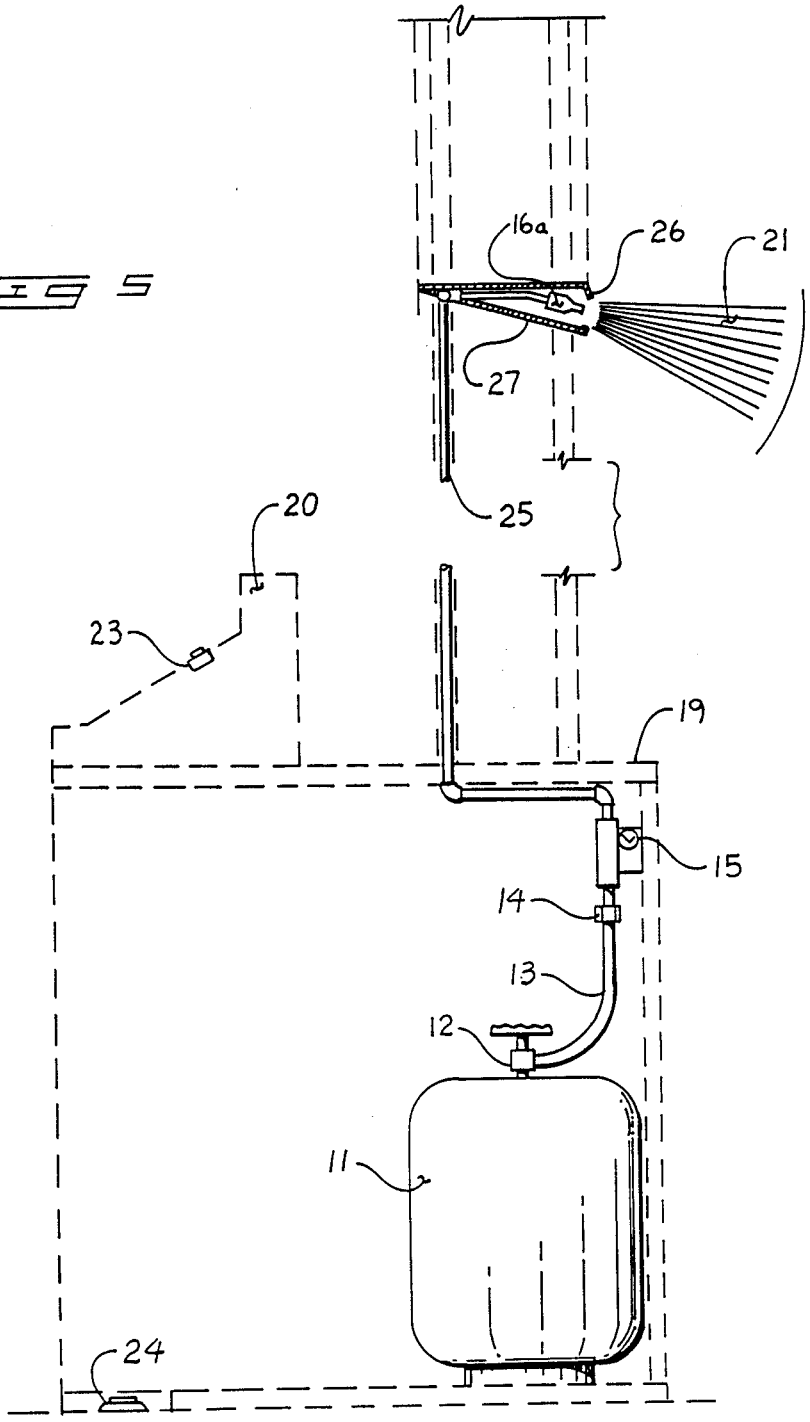
FIG. 5 is an orthographic side view taken in elevation of the invention illustrating the nozzles positioned in an overlying orientation relative to a counter arrangement.

Reference to FIG. 5 illustrates an embodiment wherein cooperation with the counter mounted bank of nozzle 16, as illustrated in FIGS. 1 through 4, an overhead bank of nozzles **16*a* arranged in a pattern similar to nozzles 16 are presented. A wall mounted conduit 25 directs the chemical within tank 11 from a controlling valve 15 wherein said nozzles 16*a* are protected by an upper protective shield 26 and a lower protective shield 27 to direct a series of conical spray patterns 21 in a similar manner, as in FIGS. 1 through 4. The upper and lower shields 26 and 27 respectively perform a similar function as shields 17 and 18 whereby hampering of the nozzling 16*a* is limited and deflecting of the spray emanating from nozzles 16*a* is limited to more readily imposed spray 21** on a would be robber or the like exclusively.

It is desirable in the application of chemical liquid of the nature utilized in the instant invention to limit the time application of discharge through nozzles 16 and accordingly valve 15 may incorporate a timing device to limit application, such as a five to ten second application has been found to be more than adequate. Utilization of such timing devices is well known in the art and the Hohmann U.S. Pat. No. 3,230,912 illustrates a similar time limit configuration and is herein incorporated by reference.

As to the manner of usage and operation of the present invention, the same should be apparent from the above description. Accordingly, no further discussion relative to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A robber deterrent apparatus for us in combination with a counter and cash register on which an individual may stand, wherein said apparatus comprises, a pressurized reservoir supply means for containing a liquid disabling chemical under pressure, and connection means operably associating said reservoir supply means to a valve means, said valve means remotely operable by either of a plurality of switch means for introducing said liquid disabling chemical to a plurality of nozzle means, and said plurality of switch means positioned behind said counter for actuation by said individual, and wherein said connection means comprises a flexible hose-like member securable to said valve means by a coupler connection enabling said pressurized reservoir means to be selectively positionable by means of said flexible connection hose, and wherein one of said switch means is mounted below said counter at a floor support level for engagement by said individual and a second switch means positioned on said cash register for enabling said selective actuation by said individual, and wherein said nozzle means are positioned within a shield means comprising an overlying shield and an underlying shield to substantially enclose said nozzles and thereby prevent tampering of said nozzles and limit deflection of spray emanating therefrom.

2. A robber deterrent apparatus as set forth in claim 1 wherein each of said nozzles project a conical pattern of said liquid disabling chemical.

3. A robber deterrent apparatus as set forth in claim 2 wherein a plurality of nozzles are positioned in overlying relationship to said nozzle means wherein said nozzle means are positioned within said counter at a terminal forwardmost portion thereof and said overlying nozzles are positioned vertically above said nozzle means to project a spray in cooperation with said nozzle means.

* * * * *